US008835788B2

(12) United States Patent
Kodama et al.

(10) Patent No.: US 8,835,788 B2
(45) Date of Patent: Sep. 16, 2014

(54) SLIDE SWITCH

(75) Inventors: Atsushi Kodama, Tokyo (JP); Toshihiko Terashita, Tokyo (JP); Tadahiko Tsutsui, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 168 days.

(21) Appl. No.: 13/212,286

(22) Filed: Aug. 18, 2011

(65) Prior Publication Data

US 2012/0043189 A1 Feb. 23, 2012

(30) Foreign Application Priority Data

Aug. 23, 2010 (JP) ..... P2010-186137

(51) Int. Cl.

| | |
|---|---|
| ***H01H 15/06*** | (2006.01) |
| ***H01H 15/00*** | (2006.01) |
| *H01H 1/40* | (2006.01) |
| *H01H 1/20* | (2006.01) |
| *H01H 1/58* | (2006.01) |

(52) U.S. Cl.

CPC ..... *H01H 15/005* (2013.01); *H01H 1/403* (2013.01); *H01H 1/20* (2013.01); *H01H 2001/5888* (2013.01)

USPC ..... 200/550; 439/83

(58) Field of Classification Search

USPC ..... 200/550, 531, 536, 547–549; 439/83

See application file for complete search history.

(56) References Cited

U.S. PATENT DOCUMENTS

| | | | | |
|---|---|---|---|---|
| 6,011,224 | A | 1/2000 | Zdanys | |
| 6,783,374 | B2 * | 8/2004 | Uratani et al. | 439/83 |
| 8,026,453 | B2 * | 9/2011 | Yasufuku et al. | 200/16 C |

FOREIGN PATENT DOCUMENTS

| | | |
|---|---|---|
| EP | 1 293 999 | 3/2003 |
| JP | S58-182238 | 12/1983 |
| JP | 9-245560 | 9/1997 |
| JP | 2004-158349 | 6/2004 |
| JP | 2005-340061 | 12/2005 |
| JP | 2009-81128 | 4/2009 |

OTHER PUBLICATIONS

European Search Report. Dated Dec. 8, 2012.

* cited by examiner

*Primary Examiner* — Felix O Figueroa

(74) *Attorney, Agent, or Firm* — Whitham Curtis Christofferson & Cook, PC

(57) ABSTRACT

A slide switch includes a housing, a plurality of fixed electrodes, and a slider. The housing includes a first face provided with an accommodating recessed part and a second face configured to be attached to an attaching board. The fixed electrodes are provided in the accommodating recessed part. Each of the fixed electrodes has an external terminal exposed on the second face. The slider has a movable electrode configured to be electrically conducted to the fixed electrodes, and is movably provided in the accommodating recessed part so as to switch an electrical conducted state of the movable electrode and the fixed electrodes.

5 Claims, 10 Drawing Sheets

*Prior Art*

SLIDE SWITCH

BACKGROUND

The present invention is related to a slide switch for various kinds of electronic devices.

A slide switch used in various kinds of compact electronic devices such as a portable telephone is known as disclosed in Patent Document 1. With a recent miniaturization of the devices, such a slide switch is also requested to be miniaturized.

The slide switch disclosed in the Patent Document 1 includes, as shown in FIG. 10, a substantially box shaped case 101 opened in an upper face and made of an insulating resin, a cover 105 which covers the opening part on the upper face of the case 101, a movable contact which comes into resilient contact with a fixed contact fixed on an inner bottom face of the case 101 to form a switch contact, an operating member 103 having an operating part 103A protruding from a side face of the case 101, accommodated in the case 101 so as to be movable rightward and leftward and having the movable contact attached and terminals 112 extended from the fixed contact and protruding outward from an end part of the case 101. The operating part 103A is slid to switch the switch contact and an electric signal is outputted to an electronic circuit of a device through a wiring pattern on a wiring board from the terminals 112 to switch various kinds of functions of the device.

For instance, in the usual slide switch disclosed in the Patent Document 1, ends of the terminals 112 are formed to protrude outside the side face of the case 101, so that the wiring patterns for connecting the terminals 112 to an external part are provided in an outer area of the case 101 on the wiring board. Accordingly, since the wiring patterns are respectively provided so as to surround an outer periphery of the case 101, especially, when the number of the terminals of the slide switch is large, an area occupied by the wiring patterns is wide. Thus, it cannot be necessarily said that a wiring efficiency on the wiring board is good. Further, since the ends of the terminals 112 protrude outside the case 101, a distance between another electronic part on the wiring board and the end of the terminal part 112 of the slide switch is shortened. Accordingly, there is a fear that an electrostatic discharge may possibly arise between the end of the terminal part 112 of the slide switch and another electronic parts to break the electronic parts.

[Patent Document 1] Japanese Patent Publication No. 2009-81128 A

SUMMARY

In such a usual slide switch as described above, the wiring pattern is not provided immediately below. Therefore, the inventor has found that, if the wiring pattern is provided in an area located immediately below the slide switch, the wiring pattern can be made to be more highly dense and an entire part of the device including an attaching board can be more miniaturized. And if the terminal part is exposed only in a bottom face, the distance between the terminal part of the slide switch and another electronic part can be more increased to prevent another electronic part from being broken.

It is therefore one advantageous aspect of the present invention to provide a slide switch in which a wiring pattern of an attaching board is made to be highly dense and there is little fear that an electrostatic discharge may arise between another electronic parts and the slide switch.

According to one aspect of the invention, there is provided a slide switch comprising:

a housing including a first face provided with an accommodating recessed part and a second face configured to be attached to an attaching board;

a plurality of fixed electrodes, provided in the accommodating recessed part, and each of which having an external terminal exposed on the second face; and a slider, having a movable electrode configured to be electrically conducted to the fixed electrodes, and movably provided in the accommodating recessed part so as to switch an electrical conducted state of the movable electrode and the fixed electrodes.

Each of the fixed electrodes may include a solder part inclined with respect to the second face and extending from the external terminal to the first face.

Each of the solder parts may include two portions which are provided in both sides of the external terminal in a moving direction of the slider.

A recessed part communicating one of spaces defined between the solder parts and the attaching board with an outer side of a side part of the housing may be provided in an outer peripheral end part of the second face.

A partition part may be provided between the spaces on the second face to prevent the spaces from communicating with each other.

DETAILED DESCRIPTION OF EXEMPLIFIED EMBODIMENTS

Figure 1:
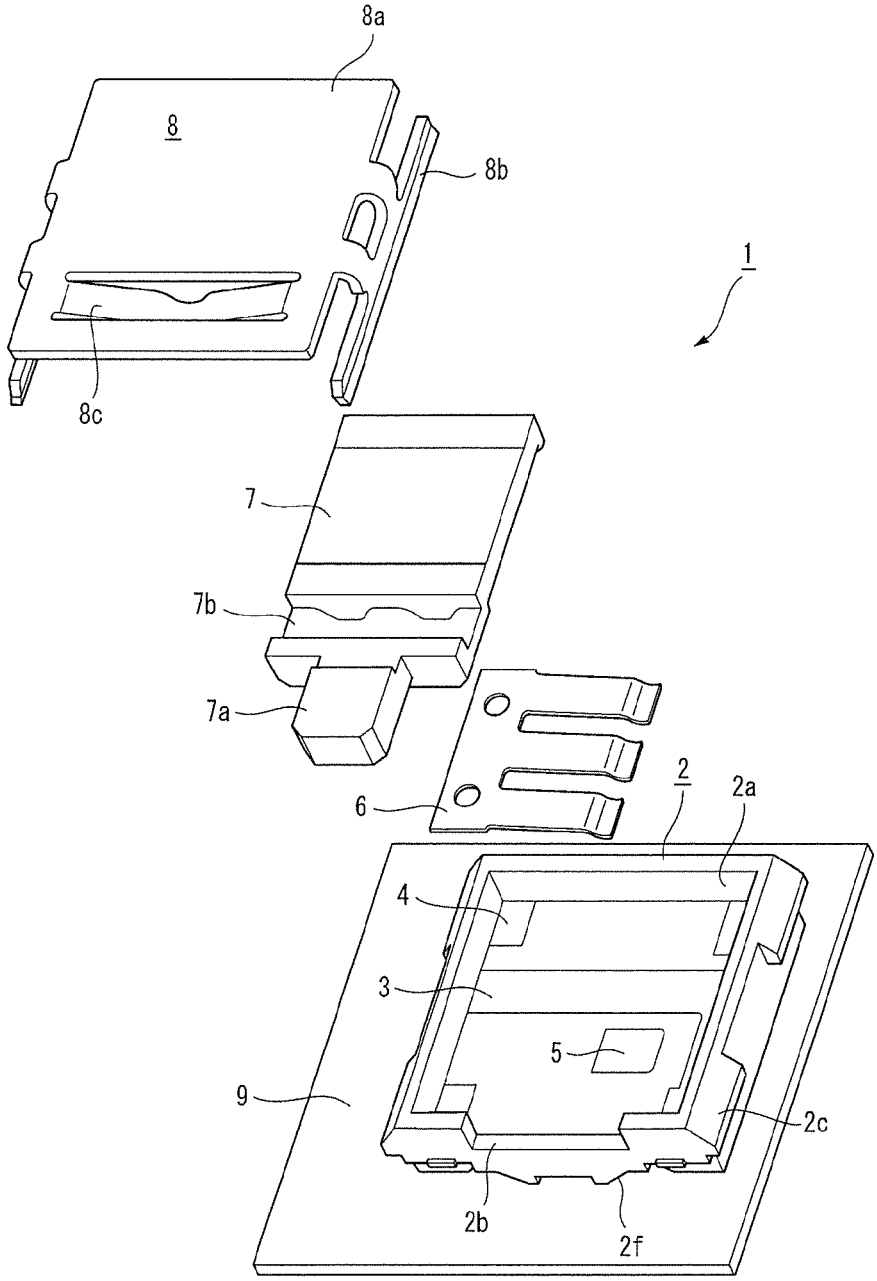
FIG. 1 is an exploded perspective view of a slide switch according to a first embodiment of the present invention.

Referring to the drawings, a slide switch 1 according to a first embodiment of the present invention will be described below.

Figure 2:
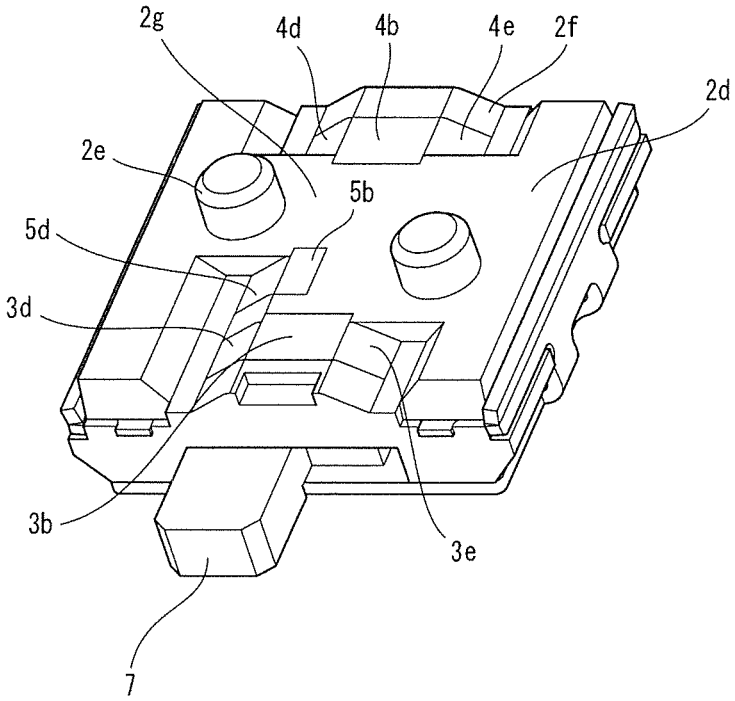
FIG. 2 is a perspective view of the slide switch shown in FIG. 1 seen from a bottom face.

FIG. 1 is an exploded perspective view of a slide switch 1 according to the first embodiment of the present invention. FIG. 2 is a perspective view showing a bottom face of the slide switch 1. As shown in FIG. 1, the slide switch 1 includes a housing 2 having an accommodating recessed part 2*a* provided on an upper face, which is claimed as a first face, first to third fixed electrodes 3 to 5 fixed to the housing 2, a movable electrode 6 which can come into contact with the first to third fixed electrodes 3 to 5, a slider 7 to which the movable electrode 6 is attached to be movable in a prescribed direction (rightward and leftward in an illustrated example) in the accommodating recessed part 2*a* and a cover 8 made of metal which covers an opening of the accommodating recessed part 2*a*. The slide switch 1 of this embodiment forms a switch having one contact and two circuits by the three first to third fixed electrodes 3 to 5 and the one movable electrode 6. In such a slide switch 1, a bottom face 2*d*, which is claimed as a second face, of the housing 2 is attached to an attaching board 9 so as to abut thereon.

The housing 2 is formed with a thin box shaped resin member and is provided with the accommodating recessed part 2*a* on the upper face thereof. The accommodating recessed part 2*a* is formed substantially in a rectangular shape and the first to third fixed electrodes 3 to 5 are arranged therein in parallel. The length (a transverse length in FIG. 1) of the accommodating recessed part 2*a* determines a moving stroke of the slider 7. Further, as shown in FIG. 2, on a bottom face 2*d* of the housing 2, positioning protrusions 2*e* are provided. Thus, the slide switch 1 can be attached to the attaching board with good positioning accuracy.

In the slider 7, a handle part 7*a* is extended outside the slide switch 1 through an opening 2*b* provided in a side face of the housing 2. To a lower face of the slider 7, the movable electrode 6 is attached. The movable electrode 6 includes contact terminals so as to correspond to the first to third fixed electrodes 3 to 5, and bent parts are provided in their ends so that they may come into resilient contact with below-described contact terminals 3*a* to 5*a* of the first to third fixed electrodes 3 to 5. In order to easily resiliently deform the contact terminals of the movable electrode 6, slits may be provided in the longitudinal direction of the contact terminals of the movable electrode 6.

The cover 8 includes a top plate part 8*a* and one pair of leg parts 8*b* protruding from the top plate part 8*a* and extending along side walls of the housing 2. When the leg parts 8*b* are engaged with pawl parts 2*c* provided in side face of the housing 2, the cover 8 is fixed to the housing 2.

On a face of the slider 7 opposed to the cover 8, positioning recessed parts 7*b* are formed which have a plurality (two in the illustrated example) of recessed parts formed adjacently. Further, at a position of the cover 8 corresponding to the positioning recessed parts 7*b*, a resilient abutting part 8*c* is provided which is formed by bending a metal piece in the shape of "<". When the slider 7 is moved, a top part of the resilient abutting part 8*c* of the cover 8 is located in any of the positioning recessed parts 7*b* to keep a position of the slider 7.

Figure 3:
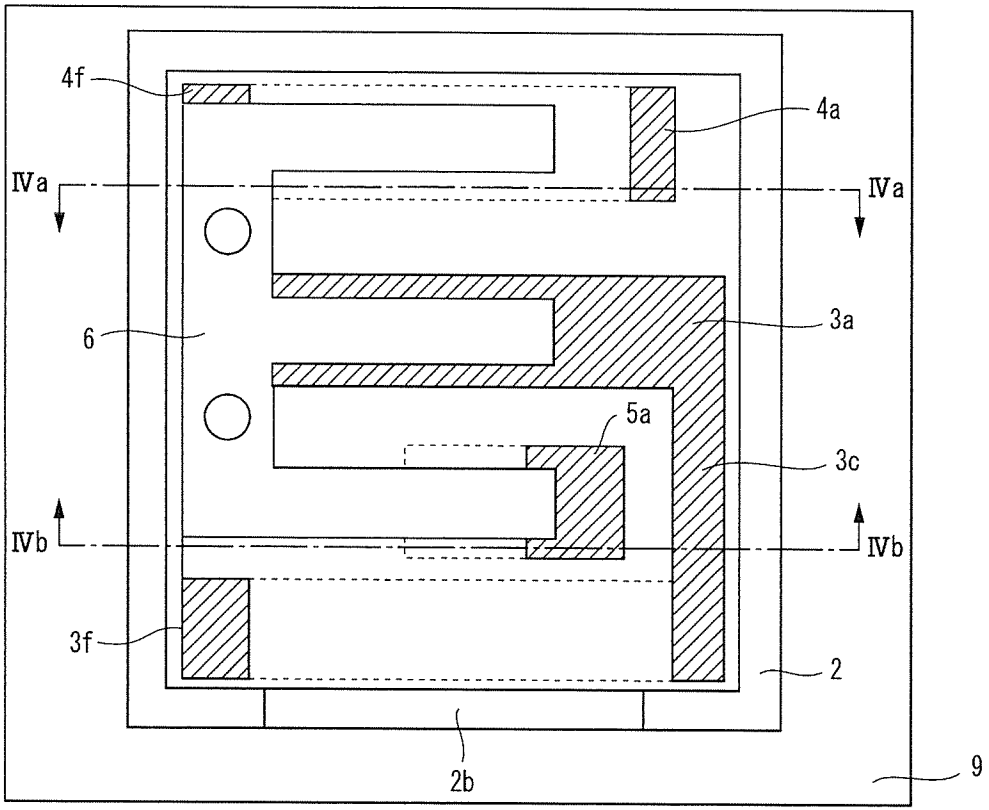
FIG. 3 is a top view showing a movable electrode, a fixed electrode and a housing of the slide switch shown in FIG. 1.
Figure 4A:
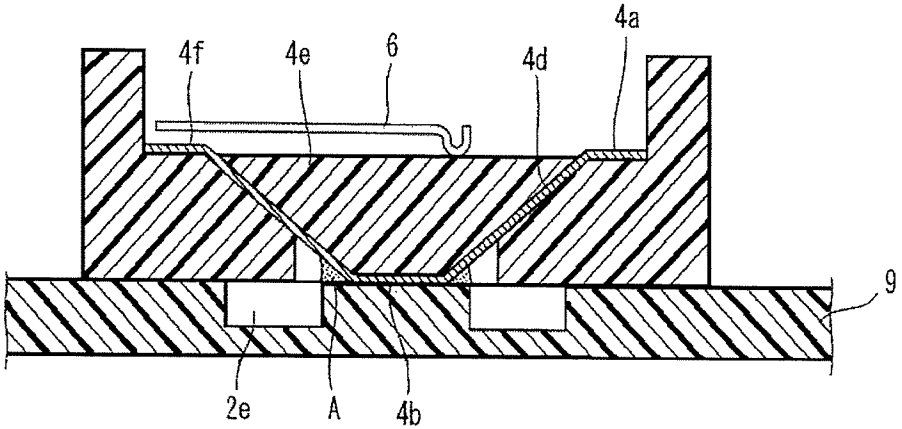
FIGS. 4A and 4B are sectional views of FIG. 3.
Figure 4B:
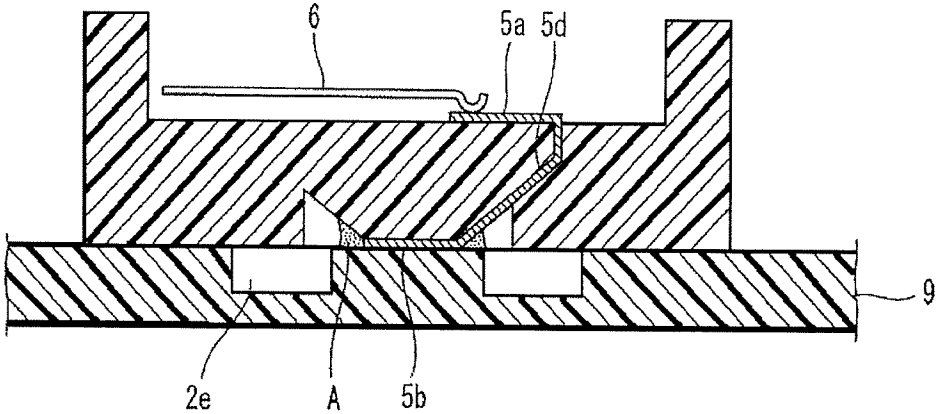
Figure 5A:
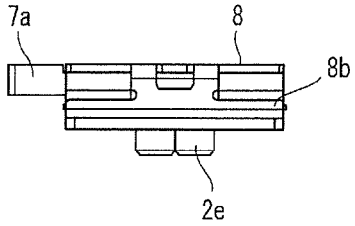
FIGS. 5A to 5E are diagrams showing the slide switch shown in FIG. 1.
Figure 5B:
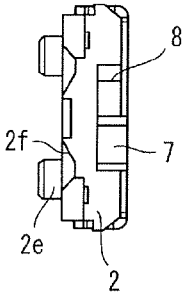
Figure 5C:
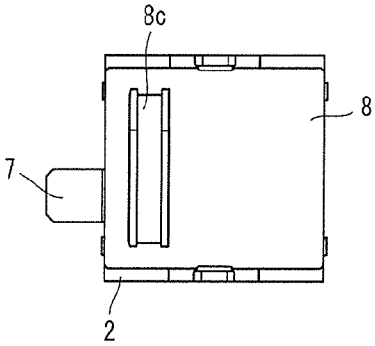
Figure 5D:
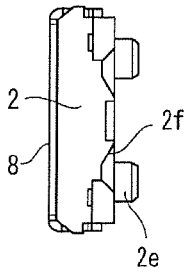
Figure 5E:
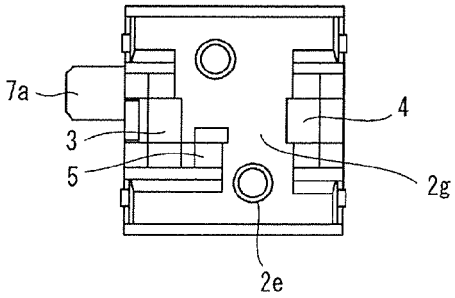

Referring to FIGS. 3 to 5E, the first to third fixed electrodes 3 to 5 will be described below in detail. FIG. 3 is a top view showing the slide switch 1 with the cover 8 and the slider 7 omitted for an explanation. Further, FIGS. 4A and 4B are respectively sectional views taken along a line IVa-IVa and a line IVb-IVb in FIG. 3. Further, in FIG. 3, areas shown by hatchings show areas of the first to third fixed electrodes 3 to 5 exposed in the accommodating recessed part 2*a*. Further, FIGS. 5A to 5E show diagrams illustrating the slide switch 1. FIG. 5A is a front view of the slide switch 1, FIG. 5B is a left side view (the handle part 7*a* side of the slider 7), FIG. 5C is a top view of the slide switch 1, FIG. 5D is a right side view of the slide switch 1 and FIG. 5E is a bottom view of the slide switch 1.

The first to third fixed electrodes 3 to 5 respectively include the contact terminals 3*a* to 5*a* which are exposed to the accommodating recessed part 2*a* and can come into contact with the movable electrode 6 and external terminals 3*b* to 5*b* exposed to the bottom face 2*d* of the housing 2 and connected to a lead-out wiring provided on the attaching board 9. The first to third fixed electrodes 3 to 5 are formed integrally with the housing 2 by an insert molding.

The first fixed electrode 3 is a metal member arranged substantially at a central part of the accommodating recessed part 2*a* of the housing 2 and having a substantially U shape in top view. The first fixed electrode 3 includes an elongated connecting terminal 3*a* exposed on the accommodating recessed part 2*a*, the external terminal 3*b* exposed on the bottom face 2*d* of the housing 2, an extending part 3*c* which goes around the connecting terminal 5*a* of the third fixed electrode 5 from the connecting terminal 3*a* and extends to the handle part 7*a* side of the slider 7 and a solder part 3*d* which passes through to the bottom face 2*d* side of the housing 2 from the extending part 3*c* to form an inclined face inclined relative e to the bottom face 2*d* of the housing 2. Further, in an opposite side to the extending part 3*c* relative to the external terminal 3*b*, are provided an additional solder part 3*e* and a support face 3*f* exposed on the accommodating recessed part 2*a*.

Since the connecting terminal 3*a* of the first fixed electrode 3 is formed over an entire length of the stroke of the slider 7, the movable electrode 6 is constantly electrically conducted to the first fixed electrode 3 irrespective of the position of the slider 7.

The second fixed electrode 4 is an elongated metal member provided in a side opposite to the handle part 7*a* of the slider 7 with respect to the first fixed electrode 3 and extending in a moving direction of the slider 7. The second fixed electrode 4 includes the connecting terminal 4*a* provided in one end of the stroke of the slider 7 and exposed on the accommodating recessed part 2*a*, the external terminal 4*b* exposed on the bottom face 2*d* of the housing 2, a solder part 4*d* which connects the connecting terminal 4*a* to the external terminal 4*b* to form an inclined face inclined relative to the bottom face 2*d* of the housing 2, an additional solder part 4*e* provided in an opposite side to the contact terminal 4*a* with respect to the external terminal 4*b* and a support face 4*f* further exposed on the accommodating recessed part 2*a* from the additional solder part 4*e*. A section of the first fixed electrode 3 including the external terminal 3*b* has substantially the same form as that of a section of the fixed electrode 4 shown in FIG. 4A.

The third fixed electrode 5 is an elongated metal member provided in a side opposite to the second fixed electrode 4 with respect to the first fixed electrode 3 and extending in the moving direction of the slider 7. The third fixed electrode 5 includes the connecting terminal 5*a* exposed on the accommodating recessed part 2*a*, the external terminal 5*b* exposed on the bottom face 2*d* of the housing 2 and a solder part 5*d* which connects the connecting terminal 5*a* to the external terminal 5*b* to form an inclined face inclined relative to the bottom face 2*d* of the housing 2.

The connecting terminal 5*a* of the third fixed electrode 5 is provided in an area which is not overlapped on the connecting terminal 4*a* of the second fixed electrode 4 within the stroke of the slider 7. In the slide switch 1 of the present embodiment, when the slider 7 is moved, an electrically conducted state of the connecting terminal 3*a* of the first fixed electrode 3 and the connecting terminal 4*a* of the second fixed electrode 4 can be switch to an electrically conducted state of the connecting terminal 3*a* of the first fixed electrode 3 and the connecting terminal 5*a* of the third fixed electrode 5.

The contact terminals 3*a* to 5*a* of the first to third fixed electrodes 3 to 5 are provided to be substantially parallel to the bottom face of the accommodating recessed part 2*a* and can smoothly come into contact with the movable electrode 6. The external terminals 3*b* to 5*b* of the first to third fixed electrodes 3 to 5 are also provided to be substantially parallel to the bottom face 2*d* of the housing 2. Thus, when the slide switch 1 is attached to the attaching board 9, a contact area to a wiring pattern on the attaching board 9 is increased.

All the external terminals 3*b* to 5b are provided at central parts in the longitudinal direction of the first to third fixed electrodes 3 to 5 in top view and located in the central part of an entire part of the slide switch 1. When the external terminals 3*b* to 5b are located in the central part of the slide switch 1 in such a way, even when the slide switch 1 is heated to be bent during a soldering operation, a distance between the external terminals 3*b* to 5b and the attaching board 9 is hardly widened, so that there is little fear that the slide switch 1 slips out the attaching board 9.

In the slide switch 1 formed as described above, since the external terminals 3*b* to 5*b* of the first to third fixed electrodes 3 to 5 are respectively exposed on the bottom face 2*d* of the housing 2, a lead-out line can be wired on an area of the attaching board 9 opposed to the bottom face 2*d* of the housing 2, which is usually a dead space, to improve a wiring efficiency. Further, as compared with a case that a lead-out line is wired on an outer peripheral edge of a slide switch so as to avoid the slide switch as in the usual switch, the outer peripheral edge of the slide switch 1 can be used for another wiring to improve the wiring efficiency.

Further, the external terminals 3*b* to 5*b* of the first to third fixed electrodes 3 to 5 are respectively exposed on the bottom face 2*d* of the housing 2 and the external terminals 3*b* to 5*b* are not exposed to a side face of the housing 2. Accordingly, since entire parts of the first to third fixed electrodes 3 to 5 are not exposed to an outer part from the side face of the housing 2 and are spaced from other adjacent electronic parts, there is little fear that the electronic parts may be broken due to an electrostatic discharge. Therefore, the first to third fixed electrodes 3 to 5 are respectively set to such sizes as to accommodate their entire parts in the accommodating recessed part 2*a*. Namely, in the present embodiment, the entire lengths of the first to third fixed electrodes 3 to 5 are set to be shorter than the length of the slider 7 in the moving direction in the accommodating recessed part 2*a*.

Further, as shown in FIG. 2, the solder parts 3*d*, 4*d*, 5*d* and the additional solder parts 3*e* and 4*e* are provided so as to be inclined relative to the bottom face 2*d* of the housing 2. Therefore, as shown in FIG. 4, between the solder parts 3*d*, 4*d* and 5*d* and the attaching board 9 and between the additional solder parts 3*e* and 4*e* and the attaching board 9, spaces having an acute angle are formed. When the slide switch 1 is attached to the attaching board 9, since solder fillets A can be effectively formed in gaps having the acute angle, an adhesion area of solder is increased to improve solder strength.

Further, as shown in FIG. 2, on an outer peripheral end part of the bottom face 2*d* of the housing 2, recessed parts 2*f* are provided which allow the spaces of the acute angle formed between the solder parts 3*d*, 4*d* and 5*d* and the attaching board 9 and between the additional solder parts 3*e* and 4*e* and the attaching board 9 to communicate with an outer side of a side part of the housing 2. The recessed parts 2*f* of the present embodiment are formed with inclined faces similarly to the solder parts 3*d*, 4*d* and 5*d* and the additional solder parts 3*e* and 4*e* and spaces similar to the spaces formed between the solder parts and the attaching board are formed between the recessed parts 2*f* and the attaching board 9.

Further, since the external terminals 3*b* to 5*b* of the first to third fixed electrodes 3 to 5 are not exposed to the side face of the housing 2 and arranged in the central part of the bottom face 2*d* of the housing 2, the solder parts 3*d* to 5*d* and the additional solder parts 3*e* and 4*e* adjacent to the external terminals 3*b* to 5*b* are also located in the central part of the bottom face 2*d* of the housing 2. Accordingly, even when the slide switch 1 is heated to generate a warp or deformation in the housing 2 made of the resin during the soldering operation, the distance between the solder parts 3*d* to 5*d* and the additional solder parts 3*e* and 4*e* and the face of the attaching board 9 is hardly changed. Thus, since solder can be made to easily adhere to the solder parts 3*d* to 5*d* and the additional solder parts 3*e* and 4*e*, the slide switch 1 can be assuredly attached to the attaching board 9.

As described above, since the recessed parts 2*f* are provided which allow the spaces formed between the above-described solder parts 3*d*, 4*d* and 5*d* and the attaching board 9 and between the additional solder parts 3*e* and 4*e* and the attaching board 9 to communicate with the outer side of the side part of the housing 2, whether or not the solder fillets A are preferably formed in the spaces can be observed from the side face of the housing 2 during the soldering operation. Accordingly, since whether or not the soldering operation is good can be simply recognized from the side face of the housing 2, efficiency for inspecting a good product can be improved. In the present embodiment, the recessed parts 2*f* are described to have the same forms as those of the solder parts 3*d*, 4*d* and 5*d* and the additional solder parts 3*e* and 4*e*, however, it is to be understood that any forms may be used which allow the spaces to communicated with the outer side of the side part of the housing 2 in place of the same forms as the inclined faces.

Further, on the bottom face 2*d* of the housing 2, a partition part 2*g* is provided that partitions the space formed by the solder parts 3*d* and 5*d* and the recessed part 2*f* provided in one side (the handle part 7*a* side) of the housing 2 from the space formed by the solder part 4*d* and the recessed part 2*f* provided in an opposite side of the housing 2. When the slide switch 1 is soldered to the attaching board 9, since the partition part 2*g* prevents the solder from extending over both the spaces, there is no fear that the external terminal 3*b* of the first fixed electrode 3 and the external terminal 5*b* of the third fixed electrode 5 provided in one side of the housing 2 is erroneously electrically conducted to the external terminal 4*b* of the second fixed electrode 4 provided in the other side of the housing 2.

Further, as shown in FIG. 2 and FIG. 4A, in the first fixed electrode 3 and the second fixed electrode 4, the solder parts 3*d* and 4*d* and the additional solder parts 3*e* and 4*e* are provided in both sides of the moving direction of the slider 7 with the external terminals 3*b* and 4*b* sandwiched between them. Accordingly, when the slider 7 is operated, even if a force is applied to the housing 2 in the moving direction of the slider 7, since the force is supported by the solder parts 3*d* and 4*d* and the additional solder parts 3*e* and 4*e* provided in both the sides, there is no fear that the housing 2 slips out from the attaching board 9.

Figure 6:
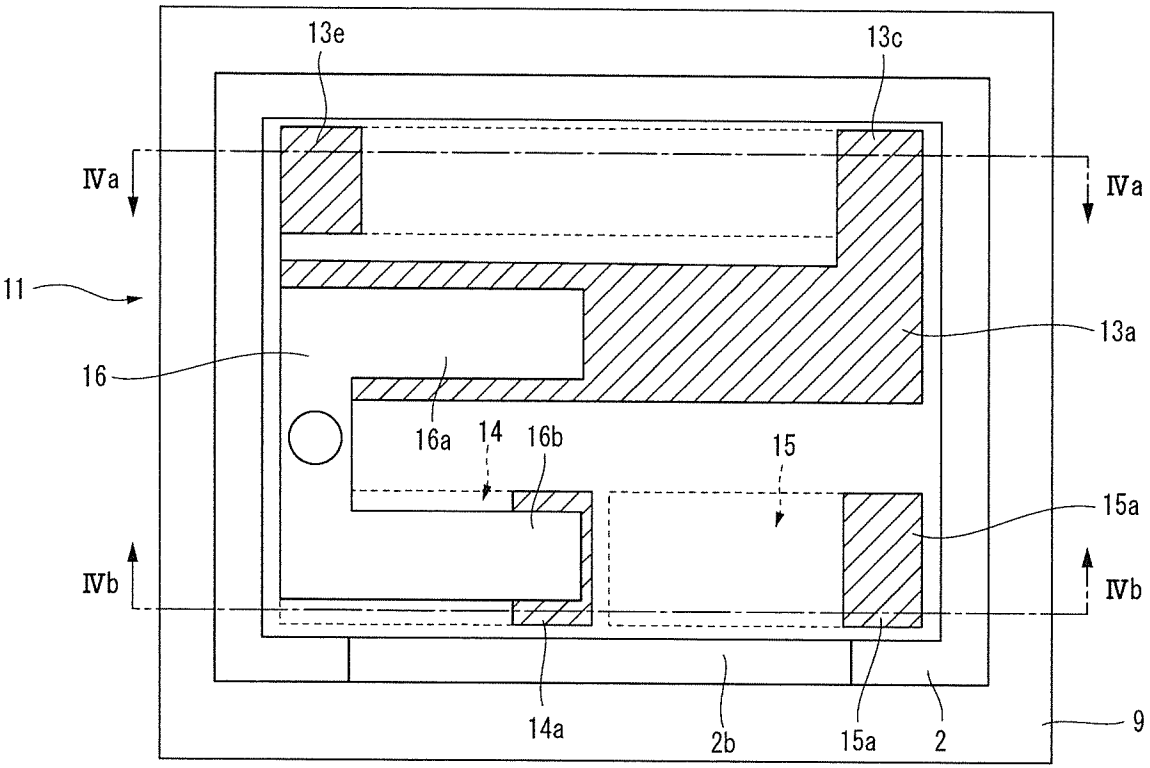
FIG. 6 is a diagram of a slide switch according to a second embodiment of the present invention which corresponds to FIG. 3.
Figure 7A:
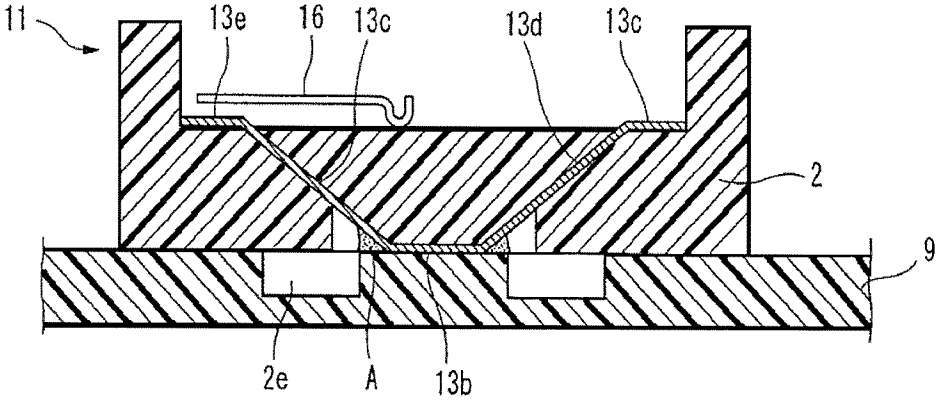
FIGS. 7A and 7B are sectional views of FIG. 6.
Figure 7B:
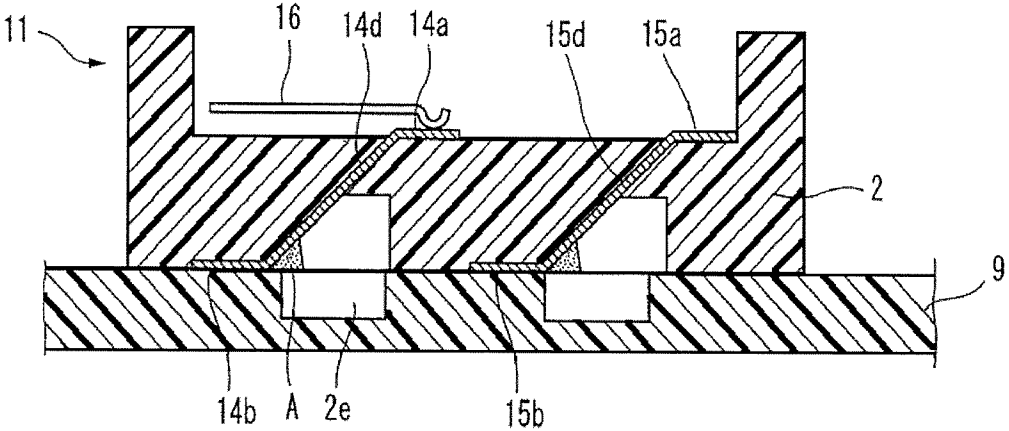

A slide switch 1 according to a second embodiment will be described below by referring to FIGS. 6 to 7B. FIGS. 6, 7A and 7B are diagrams respectively showing the slide switch 11 according to the second embodiment and corresponding to FIGS. 3, 4A and 4B. Since the slide switch 11 according to the second embodiment is different from the slide switch 1 according to the above-described first embodiment only in forms of fixed electrodes 13 to 15 and a movable electrode 16, only different points will be described below.

In the slide switch 11 according to the second embodiment, the second fixed electrode 14 and the third fixed electrode 15 are arranged on one straight line. Further, the movable electrode 16 has two contact terminals including a first contact terminal 16*a* which constantly comes into contact with a connecting terminal 13*a* of the first fixed electrode 13 and a second contact terminal 16*b* which can selectively come into contact with one of a connecting terminal 14*a* of the second fixed electrode 14 or a connecting terminal 15*a* of the third fixed electrode 15. A slider 7 is moved to switch an electrically conducted state of the second contact terminal 16*b* of the movable electrode 16 and the contact terminal 14*a* of the second fixed electrode 14 to an electrically conducted state of the second contact terminal 16*b* of the movable electrode 16 and the contact terminal 15*a* of the third fixed electrode 15. Thus, a switch operation is realized.

Also in the second embodiment, since external terminals 13*b* to 15*b* of the first to third fixed electrodes 13 to 15 are exposed only on a bottom face 2*d* of a housing 2, a lead-out wiring can be provided only in an area of an attaching board 9 which comes into contact with the bottom face 2*d* of the housing 2, similarly to the above-described first embodiment. Since the lead-out wiring can be provided in the area which is usually a dead space, the wiring of the attaching board 9 can be formed to be more highly dense. Further, even when other electronic parts are arranged in the vicinity of a side part of the slide switch 11, since the first to third fixed electrodes 13 to 15 are separated from other electronic parts, there is no fear that the slide switch 11 or other electronic parts may be broken due to an electrostatic discharge.

Further, in the slider switch 11 according to the second embodiment, since the second fixed electrode 14 and the third fixed electrode 15 are arranged on the one straight line, the slider switch 11 can be provided in which a dimension in the direction orthogonal to the moving direction of the slider 7 is short.

Further, a space formed by a solder part 13*d* of the first fixed electrode 13 and a recessed part 2*f*, a space formed by a solder part 14*d* of the second fixed electrode 14 and a recessed part 2*f* and a space formed by a solder part 15*d* of the third fixed electrode 15 and a recessed part 2*f* are respectively partitioned by a partition part 2*g*, there is no fear that the external terminals 13*b* to 15*b* may be mutually electrically conducted during a soldering operation.

Figure 8:
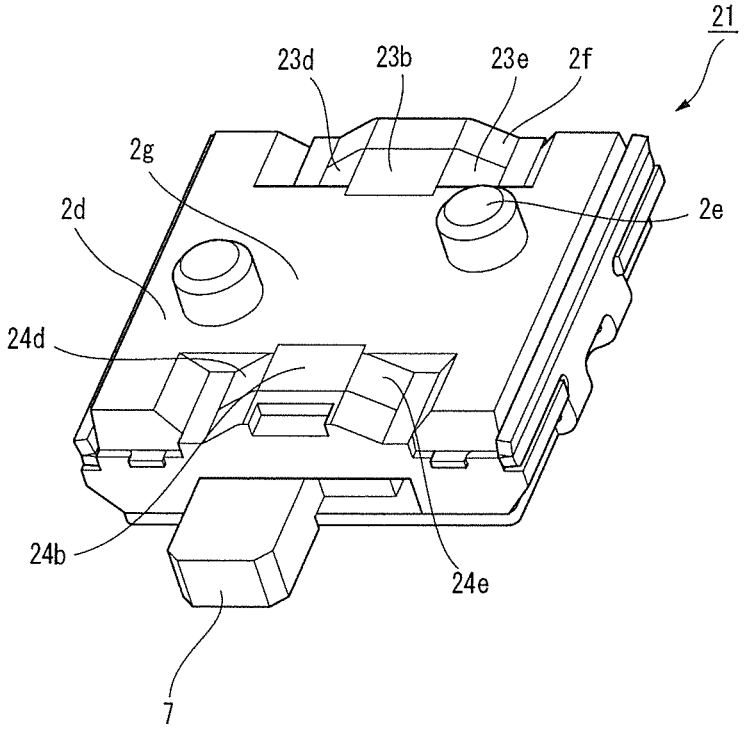
FIG. 8 is a perspective view of a slide switch according to a third embodiment of the present invention seen from a bottom face.
Figure 9:
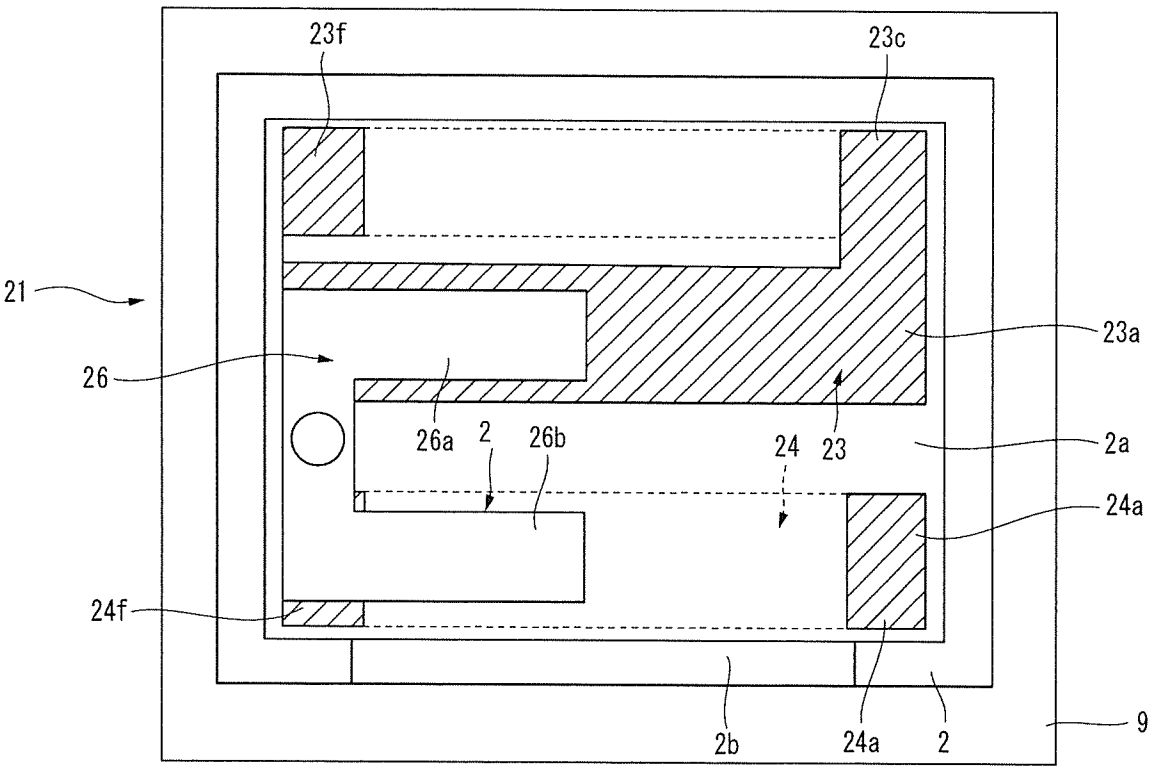
FIG. 9 is a diagram of the slide switch according to the third embodiment of the present invention which corresponds to FIG. 3.
Figure 10:
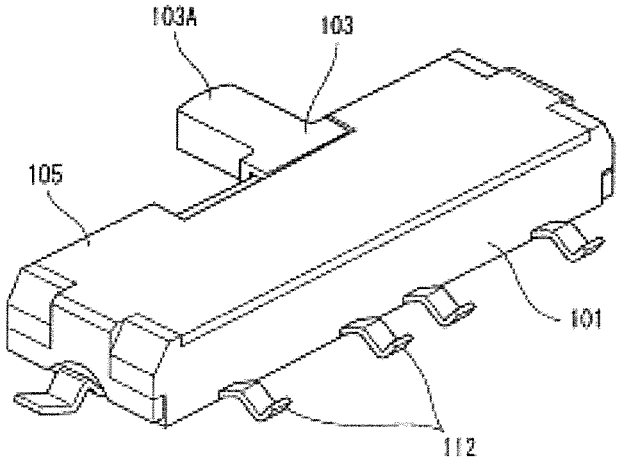
FIG. 10 is a perspective view of a slide switch according to a usual technique.

In the first and second embodiments, the slide switches 1 and 11 having the one contact and the two circuits are described as examples, however, a slide switch having one contact and one circuit (an ON-OFF switch) may be applied to the present invention. A slide switch 21 according to a third embodiment is shown in FIGS. 8 and 9. FIG. 8 is a perspective view of the slide switch 21 according to the third embodiment seen from a bottom face side. FIG. 9 is a diagram of the slide switch 21 similar to FIG. 3. Since the slide switch 21 according to the third embodiment is different from the slide switch 1 according to the above-described first embodiment only in forms of a fixed electrode and a movable electrode, only different points will be described below.

By referring to FIGS. 8 and 9 together, the slide switch 21 according to the third embodiment includes a first fixed electrode 23 which is constantly electrically conducted to a movable electrode 26 and is substantially U shaped in top view and a second long fixed electrode 24 which is electrically conducted to the movable electrode 26 only when the movable electrode 26 is moved to a prescribed position.

By referring FIGS. 8 and 9 together, the first fixed electrode 23 is a metal member arranged in an accommodating recessed part 2*a* of a housing 2 and having a substantially U shape in top view. The first fixed electrode 23 includes an elongated connecting terminal 23*a* exposed on the accommodating recessed part 2*a*, an external terminal 23*b* exposed on a bottom face 2*d* of the housing 2, an extending part 23*c* extending on the bottom face 2*d* of the housing 2 to an opposite side to a handle part 7*a* of a slider 7 from the connecting terminal 23*a* and a solder part 23*d* which passes through to the bottom face 2*d* side of the housing 2 from the extending part 23*c* to form an inclined face inclined relative to the bottom face 2*d* of the housing 2. Further, in an opposite side of the extending part 23*c* relative to the external terminal 23*b*, are provided an additional solder part 23*e* and a support face 23*f* exposed on the accommodating recessed part 2*a*.

The second fixed electrode 24 is an elongated metal member extending in the moving direction of the slider 7. The second fixed electrode 24 includes a connecting terminal 24*a* provided in one end of the stroke of the slider 7 and exposed on the accommodating recessed part 2*a*, an external terminal 24*b* exposed on the bottom face 2*d* of the housing 2, a solder part 24*d* which connects the connecting terminal 24*a* to the external terminal 24*b* to form an inclined face inclined relative to the bottom face 2*d* of the housing 2, an additional solder part 24*e* provided in an opposite side to the contact terminal 24*a* with respect to the external terminal 24*b* and a support face 24*f* further exposed on the accommodating recessed part 2*a* from the additional solder part 24*e*.

Here, the contact terminal 24*a* of the second fixed electrode 24 is exposed on one end on the bottom face of the accommodating recessed part 2*a* so that the contact terminal 24*a* of the second fixed electrode 24 is electrically conducted to the movable electrode 26 only when the slider 7 is moved to one end of the stroke. Namely, only when the slider 7 is moved to the one end of the stroke, the slide switch 21 electrically conducts the first fixed electrode 23, the second fixed electrode 24 and the movable electrode 26 to realize an ON-OFF operation.

Also in the slide switch 21, since the external terminals 23*b* and 24*b* of the first and second fixed electrodes 23 and 24 are exposed only on the bottom face 2*d* of a housing 2, a lead-out wiring can be provided only in an area of an attaching board 9 which comes into contact with the bottom face 2*d* of the housing 2, similarly to the above-described first embodiment and the second embodiment. Since the lead-out wiring can be provided in the area which is usually a dead space, the wiring of the attaching board 9 can be formed to be more highly dense. Further, even when other electronic parts are arranged in the vicinity of a side part of the slide switch 21, since the first and second fixed electrodes 23 and 24 are separated from other electronic parts, there is no fear that the slide switch 21 or other electronic parts may be broken due to an electrostatic discharge.

According to the slide switch of the present invention, since the external terminals of the fixed electrodes are exposed on the bottom face of the housing 2, the lead-out wiring can be provided in the area of the attaching board which comes into contact with the bottom face of the housing. Accordingly, since the lead-out wiring can be provided in the area which is usually a dead space, the wiring of the attaching board can be formed to be more highly dense.

Further, the external terminals of the fixed electrodes are exposed only on the bottom face of the housing and the fixed electrodes are not exposed on the side face of the housing. Accordingly, even when other electronic parts are arranged in the vicinity of the side part of the slide switch, since the fixed electrodes are separated from other electronic parts, there is no fear that the slide switch or other electronic parts may be broken due to an electrostatic discharge.

What is claimed is:

1. A slide switch comprising:

a housing including a first face provided with an accommodating recessed part and a second face configured to be attached to an attaching board;

a plurality of fixed electrodes, provided in the accommodating recessed part, and each of which having an external terminal exposed on the second face; and a slider, having a movable electrode configured to be electrically conducted to the plurality of fixed electrodes, and movably provided in the accommodating recessed part so as to switch an electrical conducted state of the movable electrode and the fixed electrodes, wherein a concave part is provided on the second face;

wherein the concave part has an inclined surface which is inclined with respect to the second face and extending from the external terminal toward the first face;

wherein each of the fixed electrodes includes a solder part, wherein the fixed electrodes are integrally formed with the housing by insert molding, so that the external terminal is exposed to the second face and the solder part is inclined in the same direction as the inclined surface and is provided on the inclined surface, and wherein at least one of the fixed electrodes includes two solder parts which are extended from both sides of the external terminal in a moving direction of the slider toward the first face, and each of the solder parts has a solder surface inclined with respect to the external terminal.

2. The slide switch according to claim 1, wherein a recessed part communicating one of spaces defined between the solder part of each of the plurality of fixed electrodes and the attaching board with an outer side of a side part of the housing is provided in an outer peripheral end part of the second face.

3. The slide switch according to claim 2, wherein a partition part is provided between the spaces on the second face to prevent the spaces from communicating with each other.

4. The slide switch according to claim 1, wherein a recessed part communicating one of spaces defined between the solder part of each of the plurality of fixed electrodes and the attaching board with an outer side of a side part of the housing is provided in an outer peripheral end part of the second face.

5. The slide switch according to claim 4, wherein a partition part is provided between the spaces on the second face to prevent the spaces from communicating with each other.

* * * * *